US008495847B2

(12) United States Patent
Rider

(10) Patent No.: US 8,495,847 B2
(45) Date of Patent: Jul. 30, 2013

(54) EVENLY DISTRIBUTED SEAMED ROOF PANEL SYSTEM

(75) Inventor: Terry L. Rider, Corinth, MS (US)

(73) Assignee: Developmental Industries, Inc., Corinth, MS (US)

( * ) Notice: Subject to any disclaimer, the term of this patent is extended or adjusted under 35 U.S.C. 154(b) by 0 days.

(21) Appl. No.: 13/069,578

(22) Filed: Mar. 23, 2011

(65) Prior Publication Data

US 2013/0047542 A1 Feb. 28, 2013

(51) Int. Cl.
*E04D 1/00* (2006.01)

(52) U.S. Cl.
USPC ..... 52/528; 52/530; 52/538; 52/545; 52/546; 52/588.1; 52/748.1

(58) Field of Classification Search
USPC ..... 52/528, 519, 545, 523, 531, 537, 52/539, 542, 546, 588.1, 748.1, 538, 529, 52/530
See application file for complete search history.

(56) References Cited

U.S. PATENT DOCUMENTS 3,759,007 A * 9/1973 Thiele ..... 52/533
4,120,123 A * 10/1978 Knudson ..... 52/86
4,649,684 A * 3/1987 Petree et al. ..... 52/395
4,870,798 A * 10/1989 Richter ..... 52/528
4,987,716 A * 1/1991 Boyd ..... 52/520
5,259,166 A * 11/1993 Carey et al. ..... 52/749.12
5,685,118 A * 11/1997 Simpson ..... 52/520
5,697,197 A * 12/1997 Simpson ..... 52/462
6,354,045 B1 * 3/2002 Boone et al. ..... 52/95
6,889,478 B1 * 5/2005 Simpson ..... 52/520
7,013,612 B2 * 3/2006 Haddock ..... 52/545
7,574,839 B1 * 8/2009 Simpson ..... 52/520
2002/0088196 A1 * 7/2002 Haddock ..... 52/543

* cited by examiner

*Primary Examiner* — Brian Glessner
*Assistant Examiner* — Brian D Mattei
(74) *Attorney, Agent, or Firm* — Wyatt, Tarrant & Combs, LLP; William S. Parks

(57) ABSTRACT

An improved roof panel system used on a building that exhibits, upon seaming, a substantially even distribution on both sides of such a seam is provided. Such a system thus permits not only increased resistance to wind uplift forces but also a more reliable roof in terms of load-bearing and load-carrying than typical single seamed roof panel systems. Particularly, the novel roof panel includes a female flange end portion with an extended "T" shape within its periphery and a male flange end portion with its own complementary "T" configuration to fit within the female flange. Such an extended "T" shape within the female flange end portion includes an extra extension that permits, upon engagement with the male flange end portion, two seams on either side of the engagement line of the two end portions of the roof panels. In such a manner, the two seams can also be compressed to become parallel with engagement line, or substantially perpendicular to the longitudinal axis of the roof line itself. A method of constructing a roof with such a roof panel system, as well as the individual roof panels themselves, and the finished roof exhibiting such a roof panel system are all encompassed within this invention.

10 Claims, 23 Drawing Sheets

EVENLY DISTRIBUTED SEAMED ROOF PANEL SYSTEM

FIELD OF THE INVENTION

The present invention relates to an improved roof panel system used on a building that exhibits, upon seaming, a substantially even distribution on both sides of such a seam. Such a system thus permits not only increased resistance to wind uplift forces but also a more reliable roof in terms of load-bearing and load-carrying than typical single seamed roof panel systems. Particularly, the novel roof panel includes a female flange end portion with an extended "T" shape within its periphery and a male flange end portion with its own complementary "T" configuration to fit within the female flange. Such an extended "T" shape within the female flange end portion includes an extra extension that permits, upon engagement with the male flange end portion, two seams on either side of the engagement line of the two end portions of the roof panels. In such a manner, the two seams can also be compressed to become parallel with the engagement line and simultaneously substantially perpendicular to the longitudinal axis of the roof line itself. A method of constructing a roof with such a roof panel system, as well as the individual roof panels themselves, and the finished roof exhibiting such a roof panel system are all encompassed within this invention.

BACKGROUND OF THE INVENTION

Metal panel roofs have become common architectural features for buildings, particularly large warehouse, retail, and convention type edifices. Such a roof is both aesthetically pleasing and functionally important to protect from natural elements, such as wind, rain, snow, and sun, and to enclose the subject building interior for environmental controls (such as temperature and humidity). Such metal roofs are also typically designed to allow for expansion and contraction due to outside temperature changes and generally constructed to ensure continued engagement of individual panels during long-term exposure to such natural elements. The panels are long strands of metal that are configured to permit engagement of different panel ends together with subsequent seaming (compressing, generally) of the engaged ends to create a resilient connection and seal from water and wind ingress. Additionally, such roof structures are typically pitched to a certain degree to effectuate water runoff as needed or properly sealed with gaskets to prevent ingress of moisture during such weather.

Wind uplift has been a major concern for seamed metal roof structures, particularly in climates that regularly exhibit such environmental phenomena. As the typical metal roof is pitched to form a peak, wind that traverses such a raised level potentially creates reduced pressure areas thereabove, resulting in a pressure differential both above and below the roof itself. Such a pressure differential thus may cause an uplift force on the individually connected panels, thereby jeopardizing the overall integrity of the entire roof, not to mention potentially compromise the seams between panels to possibly create undesirable and costly leaks. Wind damage has led to costly repairs and/or total replacements of such roof structures as well.

As noted above, typical metal roofing structures for such buildings include a plurality of parallel lengthy panels with complementary male and female edges for attachment (and seaming) with similarly configured adjacent panels. Such a continuous structure of seamed panels is also attached to an underlying edifice structure that includes purlins, joists, and bars; strong pins and/or clips, and like devices, permit strong attachment of the individual panels to the base structure.

The typical construction method thus includes the placement of a first panel atop a building purlin and permanently attaching the panel to the underlying structure as noted above. Clips and/or through-fasteners (i.e., sheet metal screws) are generally utilized to also attach adjacent roof panels to affix the panels to the building substructure and typically bear a significant amount of wind uplift forces by preventing differential movement between the panels and the support structure. However, the initial protection from high wind conditions is highly dependent on the overall structure of the seamed roof system itself; if the seams are sufficiently strong to permit the roof to remain intact upon exposure to high wind forces, the reliance upon stronger or more numerous clips for overall strength can be diminished. Thus, the provision of extremely strong and reliable roof panel seams would create a desirable wind-resistant multi-panel roof structure.

Typical roof panels include opposing female and male end flanges in complementary shapes to one another with each end portion configured in a manner that is ultimately perpendicular in relation to the roof surface itself. Thus, upon seaming of the two end portions, the finished seam between the two complementary end flange (portions) is standing from the roof surface with the actual seam engagement occurring on either side of the standing portion. In such a manner, the finished standing seam has two metal portions attached together, albeit with the actual engagement points existing on just one side of the standing portion. Basically, the previous roof panels included a female end flange portion that merely covered the male end flange portion of a different roof panel upon seaming. The typical female end flange would exhibit a standard u-shaped configuration while the typical male end flange would be roughly L-shaped to fit easily within the U-shaped receptacle female end portion. Upon seaming, the standing seam would thus be L-shaped to permit the free end of the female U-shaped end portion to fold underneath the L-shaped male portion, leaving a relatively strong seam but engaged in such a manner on one side of the shared standing seam portion of the two roof panels.

This configuration provides an effective strength to retain the overall roof structure in ambient environmental conditions, as well as a certain degree of wind uplift withstanding capabilities. Unfortunately, however, the wind updraft resistance exhibited by such typical roofing systems are limited to the strength of the one-sided standing seams themselves. If such seams loosen and/or the connected panels become detached, individual panels may then disassemble from the overall roof structure, thus compromising the entire roof in terms of environmental protection capability. The single-sided seam provided by these previous, typical roof panel configurations are limited in their potential to prevent panel detachment due to wind uplift; if one panel (such as at one edge of the entire roof structure) becomes detached, any lift movement of such a panel would invariably loosen the overall seam present with the adjacent panel, thereby reducing the reliability of such a seam to retain the edge panel in place. In effect, the unwanted lift and loosening of a panel and its seam could then result in a domino effect of further panel detachment, depending on the degree of continued wind uplift thereafter. If one panel becomes detached in this manner, however, the roof itself would most likely fail to prevent environmental problems inside the target building as the ingress of moisture, air, and any other undesirable consequences would occur.

Furthermore, the ability to increase the strength of an entire roof panel system in terms of wind uplift resistance, at least, could be affected through the increase in connection clips or other points of attachment to a building skeleton. However, such a situation creates a situation where increased labor and cost would be necessary to ensure such a result. Of additional consideration, however, is the possibility that a loosened seam connection would not only result in panel detachment, potentially, but also, even with extra points of panel attachment in place, a compromise in seam integrity to the point that moisture, air, etc., ingress would potentially occur at the adjacent panel connection points themselves, even if the panels were still in place. Proper moisture barriers (and other manners of preventing environmental damage through small openings within a roof) are of enormous importance, thus, to the utilization of such a multi-paneled roof system. With a single-sided seam in place, the possibility of seam disintegration is increased after time passes and continued environmental exposure occurs.

Additionally, such roofing systems generally require reliability in terms of permitting a person to traverse the entire roof for repairs, inspections, or any other necessity that requires such a presence. With a single-sided seam, it has been realized that uneven distribution of strength for the individual panels is exhibited in relation to a particular seam and the specific place a person may actually step on such a roof. In other words, since the torque applied to a roof surface differs from one area to another dependent upon the placement of a single-sided seam (i.e., on the side on which the seam is present, there will be more "give" in the roof panel, on the side on which the seam is not present, the roof panel will exhibit less "give", thus exhibiting an overall uneven distribution in panel strength), a person trying to traverse such a roof will face areas of uneven resistance to the force applied due the person's weight and movement. Such an uneven distribution may thus create a situation wherein traversing such a roof may be a danger to the person as hazards such as falling and/or tripping may be prevalent with an uneven surface. Furthermore, the application of forces through weight distribution and movement may also contribute to the weakening of a single-sided seam as greater tension on the seam itself may occur that will degrade over time and upon continued application of such forces, much like the wind uplift forces as discussed above.

Thus, a need exists to provide a roof panel system that compensates for the need to reduce labor costs and time through utilization of limited numbers of clips for attachment of panels to purlins and joists, as well as that increases the strength of seams present between adjacent connected panels, and accords both an increase in uplift wind resistance of even distribution of tension strengths on either side of a standing seam. To date, the typical roof panel systems fail to provide such a benefit, but rely on standard techniques of single-sided standing seams through complementary female and male configured end flange portions to that end.

ADVANTAGES AND BRIEF SUMMARY OF THE INVENTION

One distinct advantage of the present invention is the ability to generate significantly stronger standing seam roof assemblies that exhibit a reduced susceptibility to wind updrafts. Another advantage of such an invention is the ease in connecting the roof panels together through a simple placement and swivel around the seam location thereby allowing for a low requirement in manpower without increased risks of danger during installation. Another advantage provided by the inventive panel and roof made therefrom is the substantially increased, if not even, weight distribution permitted through the double-sided seam configuration between two adjacent roof panels. Yet another advantage of this inventive roof panels system is the reduction in the number of clips or other attachment devices required to provide the necessary wind updraft protections, thus reducing the labor necessary for installation of the entire roof itself.

Accordingly, this invention encompasses a single-construction metal roof panel having a first end having a first edge and a second end having a second edge, wherein said first edge and said second edge of said panel are opposite one another on either side of a center panel component; wherein said first and second ends are elevated out of the plane of said center panel component; wherein said first end is configured to exhibit a "T" shape such that the top edge of said first end is substantially parallel to at least a portion of said center panel component, such that said first end includes i) a first end rise that is at least one bend from said center panel component at an angle greater than 0 and at most 90° from the plane of said center panel component, ii) a first end flange that includes a 90° bend away from said rise and toward a plane parallel to said center panel component, and iii) a further 180° bend in the direction opposite of said 90° bend also in a direction substantially parallel to the plane of said center panel component which leads to said first edge of said first end, and wherein said first edge of said first end of said roof panel extends beyond the furthest point of said first end rise away from said center panel component; wherein said second end includes i) a second end rise that is at least one bend at an angle greater than 0 and at most 90° from the plane of said center panel component, ii) a second end flange that includes a 90° bend away from said rise and toward a plane parallel to said center panel component, iii) an acute angle bend that is less than 180° in the direction opposite of said 90° bend also in a direction substantially parallel to the plane of said center panel component, and iv) a further bend of any angle that leads to said second edge of said second end, and wherein said second edge of said second end of said roof panel extends beyond the furthest point of said second end rise away from said center panel component; wherein said second end flange of said panel is complementary in shape to accept a first end flange from a substantially identical single-construction roof panel. Also encompassed within this invention is the method of forming a roof assembly of a plurality of such roof panels as described above and herein through the complementary introduction of a first end flange of one roof panel into the second end flange of an adjacent roof panel to form a seam connection and thereafter seaming both of said flanges together through the first deformation of the second edge of said second flange around the first edge of said first flange to form a "T" shaped connection seam with said first flange covered by said second flange. Furthermore, if desired, the inventive method may also include the further deformation of said "T" shaped connection seam through the deformation of the resultant "T" shaped connection seam such that both of the top ends of said "T" shaped connection seam are manipulated to a direction substantially perpendicular to said the center panel component of at least one of said roof panels, and wherein said direction is substantially parallel to at least a portion of said first and second rise of both panel ends.

In the roofing industry, an edifice is first erected through providing the building skeleton (girders, beams, etc.) as well as potentially, particularly for commercial buildings, brick, stone, or other like materials for outside walls. The roof thus must be constructed on site, and atop the building skeleton. Multiple types of roofing materials could be utilized for such a purpose; the types at which the inventive apparatus and method are directed are those that involve relatively long, but relatively narrow, panels that, as discussed throughout, are attached through seams to produce a single roof assembly. Such panels include the elevated female and male members as noted above for such seaming purposes; in addition, though, the seams provide excellent characteristics in relation to thermal expansion and contraction possibilities, in addition to the low slippage and watertight properties highly desired. The stronger the seam, however, the better the overall protection to the roof assembly from damaging high winds.

Such panels are generally made from different gauge metals (such as steel, stainless steel, aluminum, and the like), and are selected in terms of their load properties, among other reasons. The flexibility of the panels is important in terms of the above-discussed characteristics for thermal expansion and wind resistance; however, the load itself also contributes to the potential difficulties with seaming of the elevated end portions together as well. This potential issue can be compensated for with the a proper manually propelled or motorized seaming apparatus (such as a motor attached to a movable base) exhibiting the proper torque to maneuver the female and male end portions as needed for proper seaming to be accomplished. Generally, aluminum exhibits the lowest gauge and thus is easier on the motor of the seaming apparatus; however, such a material also exhibits the least reliability in terms of roof assembly panels as well, due to its malleability level. Steel and stainless steel (and other like higher gauge metals) are thus preferred. Additionally, to protect from environmental and water damage, the metal surface is usually accorded a proper coating (anti-rust paint, for example).

Furthermore, the adjacently disposed roof panels are supported by an underlying support structure to which the panels may also be attached through clips or other like objects. Backer and/or cinch plates may be added to the overlapped edge seams in the roof assembly as well, if desired, to increase the overall strength of the roof. The basic idea, however, behind this inventive roof panel and resultant roof assembly made therefrom is the ability to reduce attachment points and other add-on materials without compromising the overall strength of the target roof itself.

In essence, this invention is based upon the ability to form a single-construction panel that constitutes the base component of a roof assembly constructed from a plurality of substantially identical roof panels of the type described above. Typical single-construction panels include flanged ends that permit single-sided seams to be created for installation. In such previous roof assemblies, however, the capability of the overall roof to withstand wind updraft exposure was limited to the strength of such single-sided seams. The overlap and deformation of the female flange edge over the male counterpart of an adjacent panel would create such a single-sided seam in relation to the actual seam connection itself; unfortunately, the application of any number of external forces (wind updraft, installer weight, etc.) could effectively loosen the single-sided seam rather easily. Over time, with the seam centered on one side of the panel connection, continued exposure to such external forces would leave the overall assembly susceptible to wind updraft, etc., damage as a result. Additionally, a single-sided seam creates a single location for moisture ingress leaving the overall assembly, again, susceptible to greater potential damage as a result. Furthermore, as noted above, the weight of an installer, repairperson, or just a person standing or traversing such a roof assembly, could lead to uneven distributions throughout the roof leading, potentially, to injuries due to difficulties in maneuvering and balancing on such a roof assembly surface. A stronger seam, or at least a stronger attachment to the base edifice skeleton (through pins, curlins, and the like), would aid in alleviating such weight distribution issues; however, the increase in numbers of attachment points increases labor costs as well as material costs. The inventive roof panel, and thus the inventive roof assembly made from a plurality of such substantially identical roof panels, remedies such shortcomings and permits a significant reduction in the expected costs, complexities, and numbers of material parts necessary to erect and install a roof assembly that would provide very high wind updraft resistance, substantially even weight distribution over standing seams, and reduction in moisture ingress points.

The inventive system thus comprises a plurality of roof panels comprising a horizontal channel section bounded on opposing edges by a pair of side flanges. An upper end of each side flange is bent to provide a groove which opens outwardly laterally from the panel; the side flanges are connected to rises in both ends on either side of a center panel component. Such rises may be of any configuration in relation to the plane of the center panel component and may include any number of sub-rises, if desired, to provide either a straight line rise, a trapezoidal rise, or any other geometric configuration. The ability to provide channels in the roof panels, and thus a plurality of channels, other than created by the straight, perpendicularly aligned rises in such assemblies, within the overall roof assembly itself, aids in allowing for water, ice, etc., to run-off, as well as providing differing manners of air circulation, and the like, within the edifice itself. Each of the panels thus has a pair of oppositely extending flanges running the length of each end; one configured in female relation (and thus complementary in shape for connection, nesting, and eventual seaming) to a male configuration. Although a reduction in number of attachment to the building skeleton is provided with the inventive panel configurations, it is still preferable to provide attachments between at least some of the areas of each roof panel to a joist, bar, etc., to best ensure integrity of the roof panel during and after installation.

Particularly, the novel roof panel includes a female flange end portion with an extended "T" shape within its periphery and a male flange end portion with its own complementary "T" configuration to fit within the female flange. Such an extended "T" shape within the female flange end portion includes an extra extension that permits, upon engagement with the male flange end portion, two seams on either side of the engagement line of the two end portions of the roof panels. In such a manner, the two seams can also be compressed to become parallel with engagement line, or substantially perpendicular to the longitudinal axis of the roof line itself. This ultimate configuration provides a significant increase in not only seam strength but overall roof system strength such that any wind uplift forces would necessarily require peeling of the entire roof, rather than disengagement of individual seams, to degrade the roofing structure. The distribution of strength on either side of the engagement line of adjacent roof panels would be substantially even as well, thereby providing a reliable surface on which one can maneuver without creating indentations or disfigurement in roof panels due to uneven stresses within such seams. Such an improvement in panel shape thus accords the aforementioned drastic increase in strength and overall tension distribution for the roof assembly made therefrom. The term "extended 'T'" is thus intended to encompass a lengthwise configuration on the edge of a roof panel that includes an extra extension from the edge of the "T" closest to the edge of the roof panel itself, such that the extra extension allows for the "T" shape of a complementary male edge of an adjacent roof panel to be placed fully within such an extended "T" edge for seaming to be accomplished of both the female and male edges. In practice, the "extended 'T'" does not have to actually appear as a "T" shape when viewed from the non-seamable edge of the roofing panel itself (as opposed to the male edge which must be a "T" shape from the same perspective). As long as the female edge includes a compressible top portion that may, upon compression downward along the length of the female edge itself, appear as a "T", but with an extended edge in addition thereto, then the requirement of an extended "T" shape is met. The accompanying drawings provide a proper description and depiction of such a female edge at least in one potentially preferred embodiment. The extended edge of the female extended "T" configuration may be disposed at any angle from the edge of the "T." As well, the top portion of the extended "T" may be disposed at any angle from the vertical portion of the "T" if desired.

As noted above, the seaming operation may be accomplished through manual or self-propelled seaming methods (i.e., a motorized seaming apparatus). Such an apparatus is discussed in U.S. patent application Ser. Nos. 12/467,068, 12/467,087, and 12/467,095, all herein incorporated in their entirety by reference. Such an apparatus basically seams a target interlocked set of roofing panels length-wise. As noted above, as well, if desired, the user may provide any degree of crimping and/or seaming to the target interlocked roof panels, thus, a single-sided seam of a simple deformation of the extended "T" edge of the female flange over the smaller "T" edge of the male flange may be accomplished (at the very least). More preferably, however, is that the seaming apparatus deforms the "T" shape of both the female and male flanges downwards until the edges (in nested related to one another) are folded over the portion of the rises of the two adjacent panels in a configuration parallel to the plane of the rises that is perpendicular to the plane of the center panel component of both adjacent panels themselves. Thus, as long as the seaming process is applied to that degree (in the preferred method), any type of seaming apparatus (including manual crimping if so desired) may be employed. Preferably, the seaming apparatus would be motorized and applied to a first side of the interlocked adjacent panels to create the initial deformation on a first side (thus, creating the initial "T" formation of both end flanges together), then forcing the entire interlocked first side of the seam downward as noted above along the entire length of the target interlocked roof panels. Subsequently, a user or users may then take the seaming apparatus and turn it around to return along the same interlocked seam, but on the side opposite that already deformed and seamed (at least, in a preferred method). In that manner, the same seaming apparatus may be utilized for such a purpose. Alternatively, the user or users (installers, that is) may utilize two different seaming apparatuses, one for the first side of the seam to be created, and another for the second side. The important limitation is basically that, if full compliment seaming is desired, that both seam sides are created to the degree necessary to reduce the need for extra attachment points without compromising wind updraft resistance ultimately.

The components of the apparatus may be of virtually any material of suitable strength to impart sufficient torque and resist rupture or any other like structural failure during a seaming operation. Certain parts may be of plastic construction if they are not in contact with the targeted roof panels themselves (such as handle covers, adjusting shafts, and the like) or used as wheel components. To initiate the seaming process, it may be necessary for the installer to utilize a manual crimper on the first few inches of the target overlapping panels.

The method of installation thus allows for the placement (and potentially preferred attachment to a building skeleton) of a first panel wherein either end flange of the first panel is accessible and located in a direction that allows for complementary introduction and interlocking of the opposite end flange of a second panel in total. The introduction of a female flange end should be facilitated by the specific configuration of the extended "T" therein over the common "T" of the male flange end. This configuration thus contributes to a safer environment during installation as well since the female flange end can be easily placed and then swiveled over the male end flange without appreciable dangers of such an interlocked combination from skewing. As a result, the ability to provide such an improved nesting relationship between opposing panel edges creates a more reliable seaming procedure since the installer(s) could not create the necessary seam between the interlocking panels unless they are aligned properly. The extended "T" female end and the common "T" male end thus could not align properly without proper nesting of the complementary configurations. As such, the benefits of this novel roof panel, particularly when assembled in a roof configuration, are increased in number. Lastly, the overall aesthetic appearance of the roof assembly made from such novel roof panels, particularly when all of the double-sided seams are properly made over the assembly's entirety, is novel itself. Typical seamed roof assemblies include, as noted above, single-sided seams leaving the roof appearance uneven and favoring one side. This result not only contributes to the aforementioned uneven weight distribution, as well as the moisture ingress problem potential, but provides an overall look to the roof that may not be as sharp as that of a double-sided seam alternative. As such, the benefits of the overall configuration provided by this novel roof panel and assembly made therefrom are, again, unexpectedly good.

DETAILED DESCRIPTION OF THE DRAWINGS AND PREFERRED EMBODIMENTS

Figure 1:
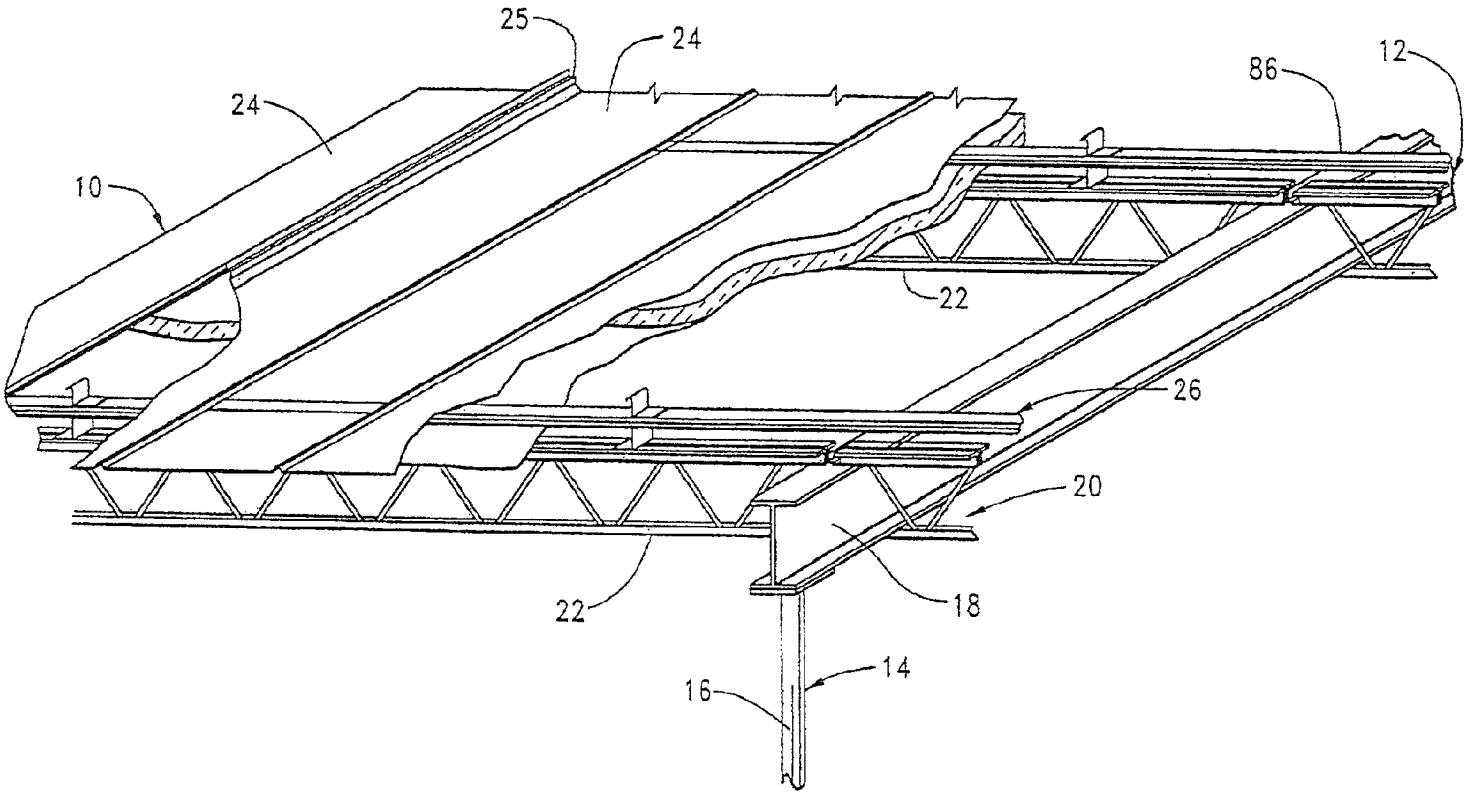
FIG. 1 is an isometric, partial cut-away view of a portion of a roof system utilizing a standing seam roof assembly.

A better understanding of the present invention will be had when reference is made to the accompanying drawings, wherein identical parts are identified by identical reference numerals. Such a depiction is for a presentation of the potentially preferred embodiments of the invention and is not intended to limit the breadth of the invention in any manner. The ordinarily skilled artisan would have sufficient understanding and respect for this specific art in order to consider the true breadth of the invention itself in relation to the overall descriptions.

Referring to FIG. 1, there is depicted a pre-engineered building roof 10 supported by a pre-engineered building structure 12. Such a pre-engineered structure 12 comprises a primary structural system 14 including a number of upwardly extending column members 16 [to be connected to a base foundation (not illustrated)]. Also, the primary structural system 14 has a plurality of beams 18 which are supported by the column members 16.

Also included is a secondary structural system 20 including a number of open web beams 22 attached to and supported horizontally by the primary beams 18. Alternative structures may be employed in place of these web beams 22, if desired. A plurality of roof panels 24 are supported over the secondary structural assembly 20 by a plurality of panel support assemblies 26 and are attached to the upper flanges of the web beams 22. The roof panels 24, only portions of which are shown, are depicted as being standing seam panels with interlocking standing seams 25 connected by clip portions of the panel support assemblies 26. Alternatives to such clips may be practiced as well and other clips may be incorporated within the panels to hold them in place with the building skeletal portions noted above.

Figure 2:
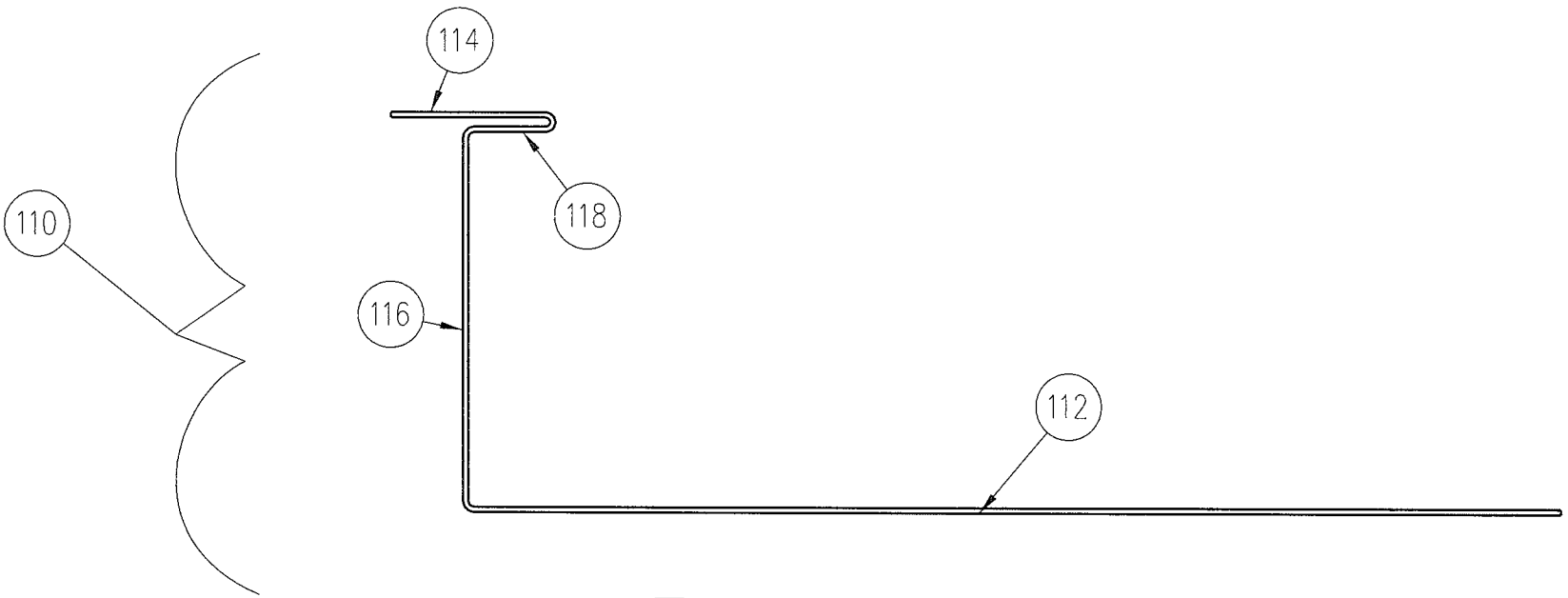
FIG. 2 is a cross-sectional view of the male end portion of an inventive straight-rise roof panel.
Figure 3:
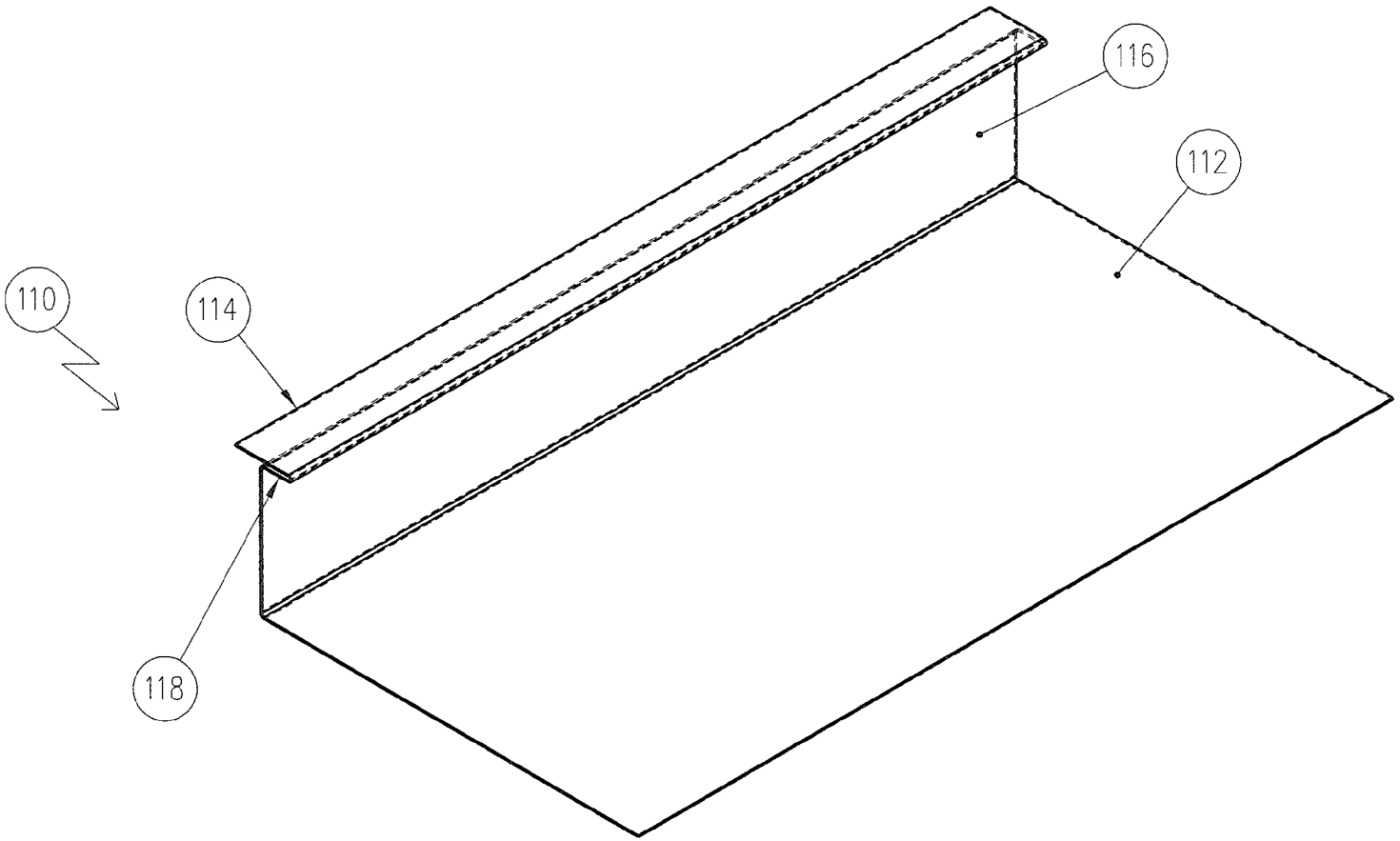
FIG. 3 is an isometric view of the same male end portion of FIG. 2.

FIGS. 2 and 3 depict the male end portion 110 of an inventive end panel (partially shown as the center panel component 112). The end portion 110 includes an elevated straight rise 116 (i.e., bends substantially 90° degrees from the plane of the center panel component 112) that leads into a top end component 118 that bends substantially 90° from the plane of the rise 116 back toward the direction of the center panel component 112 and is substantially parallel to the plane of the center panel component 112. Another bend of substantially 180° in the material creates a top edge 114 that extends beyond the furthest point of the rise 116 in relation to the center panel component 112. This male end portion 110 thus forms a "T" shaped configuration, which is thus the definition of such a term throughout the description of this invention. As noted in FIG. 3, the "T" shaped configuration extends along the entire length of the rise 116.

Figure 4:
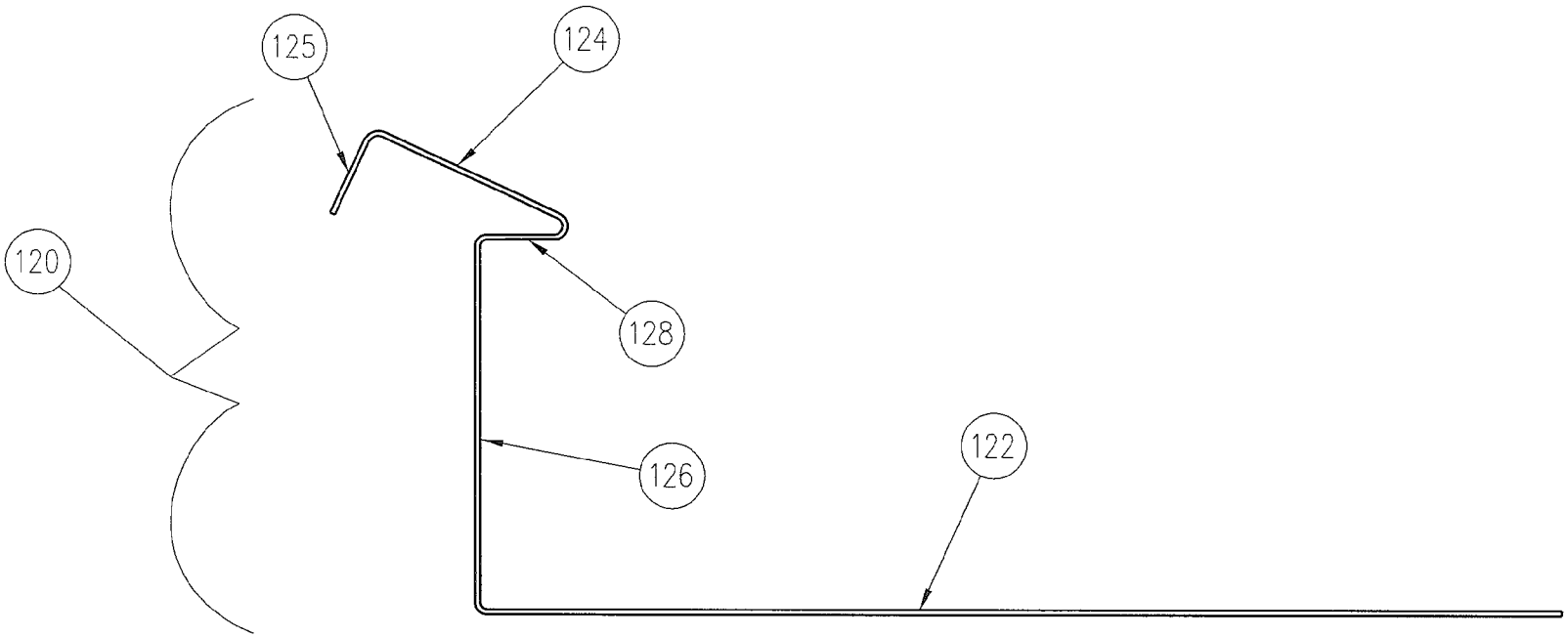
FIG. 4 is a cross-sectional view of the female portion of an inventive straight-rise roof panel.
Figure 5:
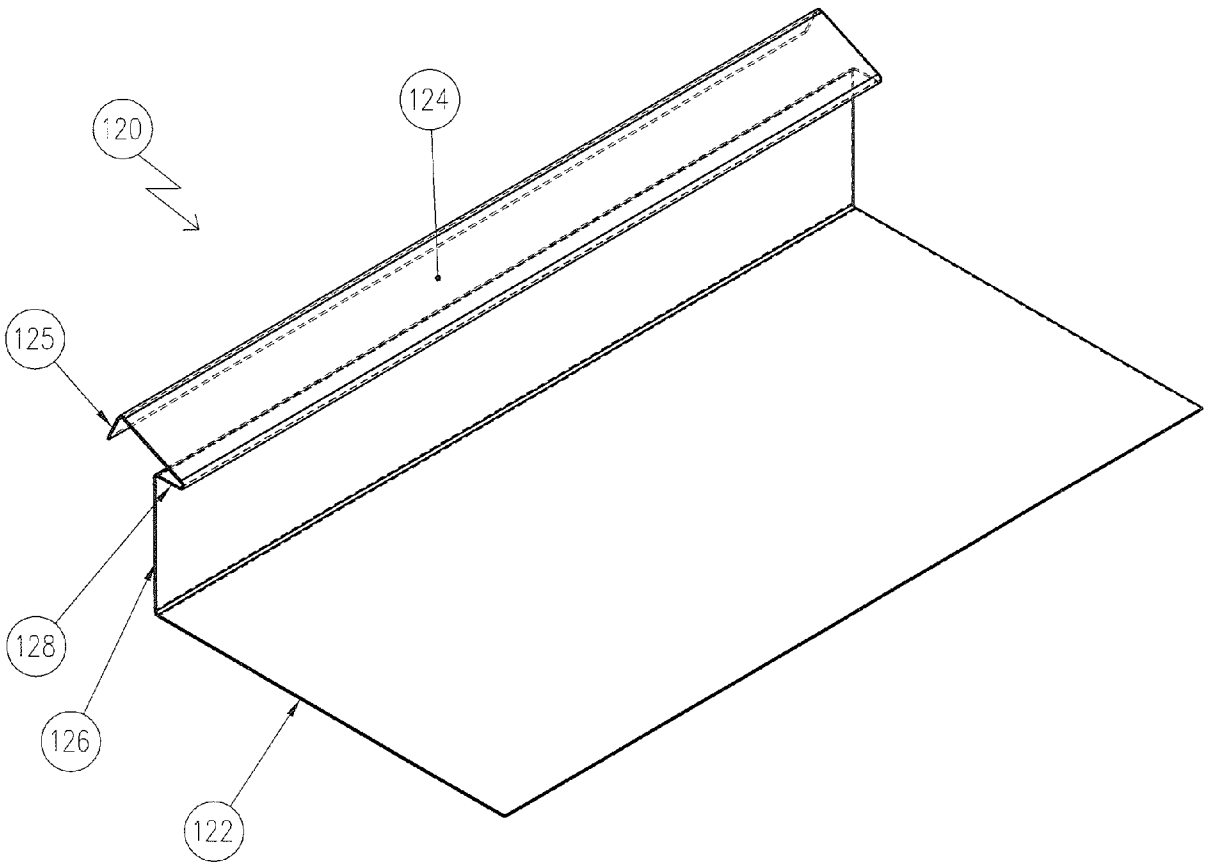
FIG. 5 is an isometric view of the same female end portion of FIG. 4.

FIGS. 4 and 5 depict a female end portion 120 of an inventive end panel (partially shown as the center panel component 122). The end portion 120 includes an elevated straight rise 126 (i.e., bends substantially 90° degrees from the plane of the center panel component 122) that leads into a top end component 128 that bends substantially 90° from the plane of the rise 126 back toward the direction of the center panel component 122 and is substantially parallel to the plane of the center panel component 122. Another bend is present in the material creating an acute angle (i.e., greater than 0 but less than 90°) from the plane of the top end component 128. In this embodiment, the acute angle is roughly 30° and extended top portion 124 is created within the end portion 120 as a result. The edge 125 of the end portion 120 is then created by a further bend (of any angle; in this preferred embodiment the angle is roughly 90° from the extended top portion 124) that further extends a distance below the extended top portion 124. Such a configuration is defined herein as an extended "T" shape as the configuration of the bends within the end portion 120 create a shape that is accommodating of the "T" shaped end of the FIGS. 2 and 3 end portion 110. Thus, this general configuration (wherein the acute angle is defined as above and the bend angle away from the extended top portion 124 is defined as above, as well) is the definition of such a term (extended "T" shaped) throughout the description of this invention. As noted in FIG. 5, the extended "T" shaped configuration extends along the entire length of the rise 126. Additionally, as alluded to above, the extended "T" shape edge allows for introduction of and nesting of the "T" shaped configuration of the male end portion 110 of an adjacent roof panel.

Figure 6:
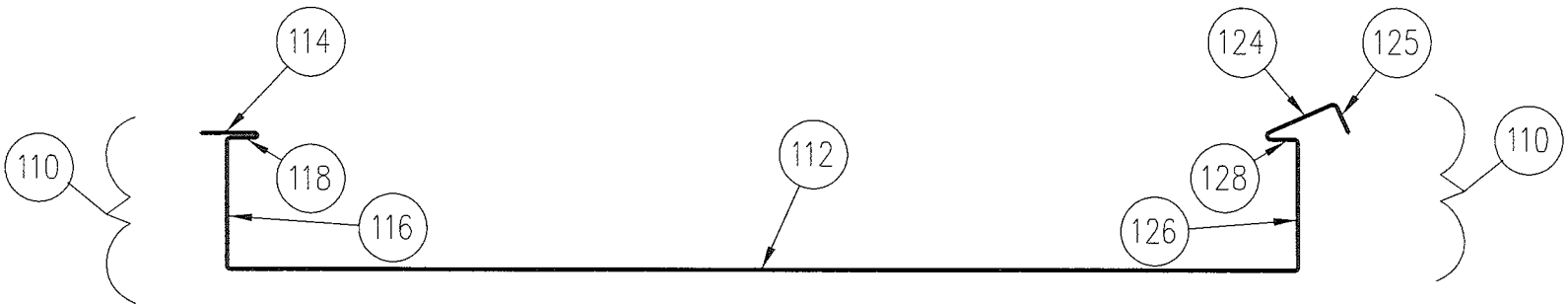
FIG. 6 is a cross-sectional view of one potentially preferred embodiment of the inventive straight-rise roof panel.
Figure 7:
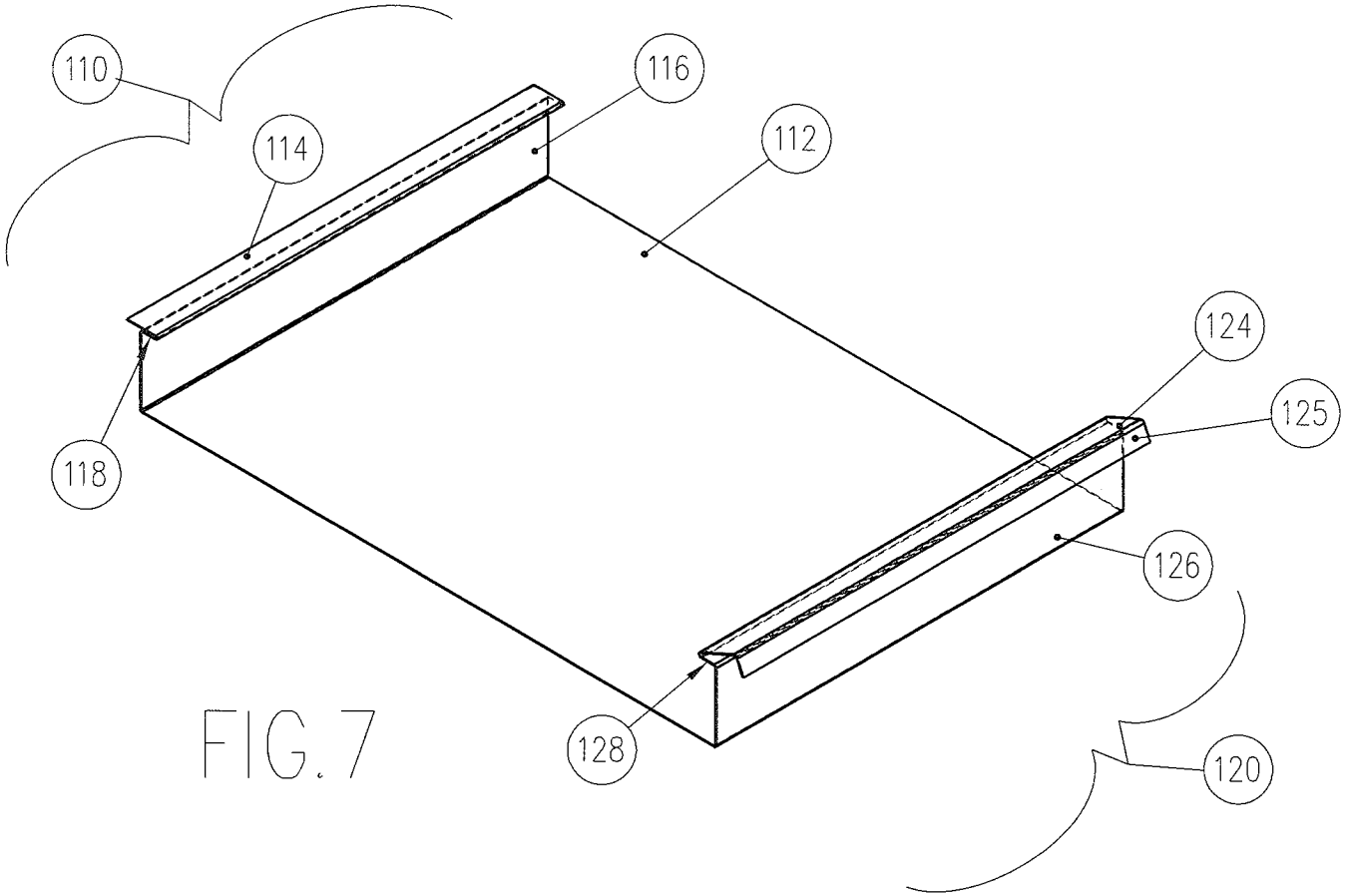
FIG. 7 is an isometric view of the same roof panel of FIG. 6.

FIGS. 6 and 7 thus depict an entire inventive straight rise panel including the same configurations as in FIGS. 2, 3, 4, and 5, above.

Figure 8:
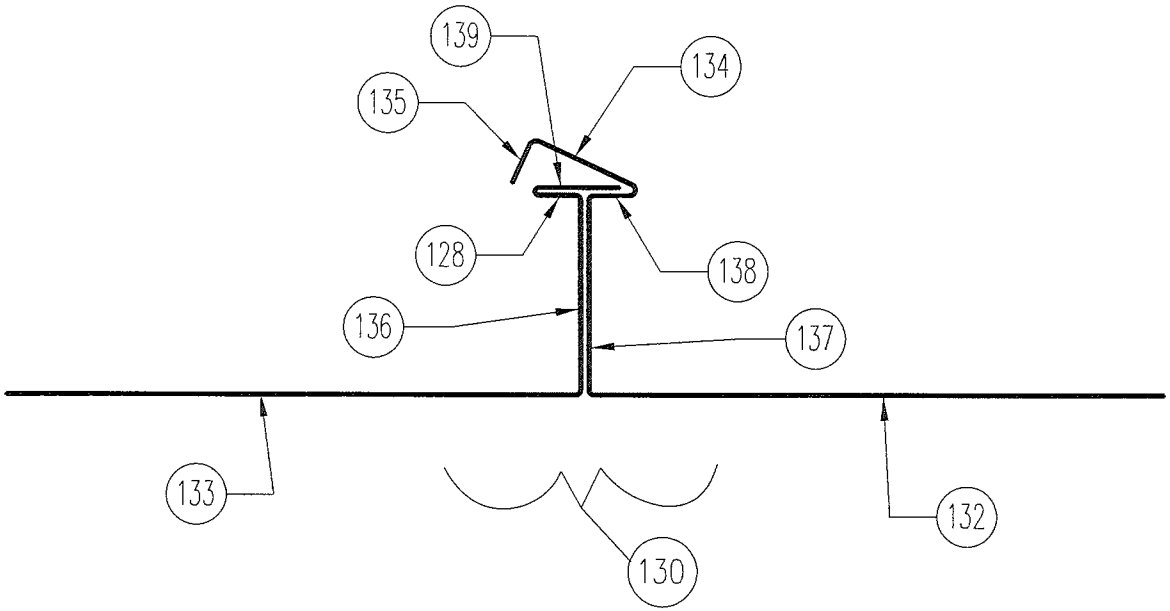
FIG. 8 is a cross-sectional view of interlocked female and male portions, as presented in FIGS. 2, 3, 4, and 5, of one potentially preferred embodiment of two inventive roof panels prior to seaming.
Figure 9:
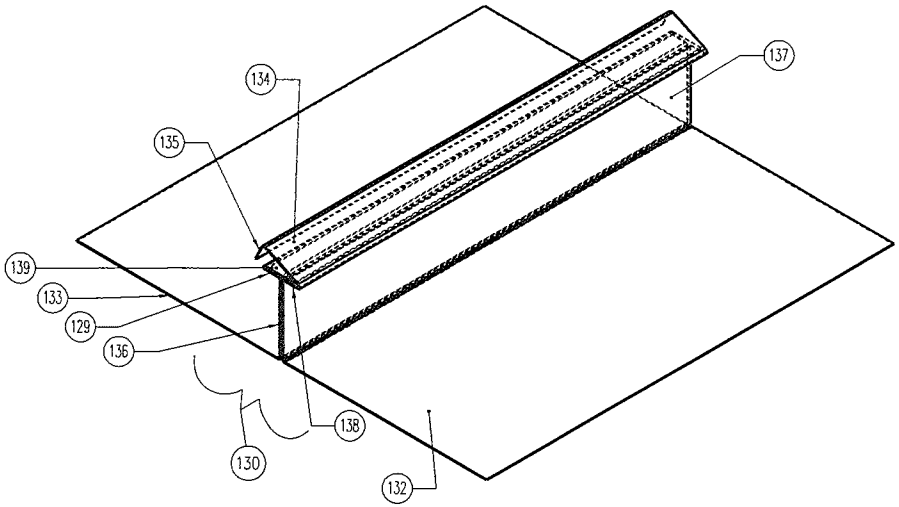
FIG. 9 is an isometric view of the same interlocked roof panels of FIG. 8.

FIGS. 8 and 9 depict the interlocking of adjacent inventive straight rise panels (partially displayed as separate center panel components 132, 133). A seam connection 130 is present showing the two straight rises 136, 137 and the complementary nesting of the male end portion (110 in FIGS. 2 and 3, for example; in FIGS. 8 and 9, the male end portion is shown with top end component 129 and top edge 139) within the larger female end portion (120 in FIGS. 4 and 5, for example; in FIGS. 8 and 9, the female end portion, or extended "T" shaped portion, is shown with top end component 138, extended top portion 134, and edge 135). As above, the nested "T" shape and accommodating extended "T" shape configurations run the length of the rises 136, 137.

Figure 10:
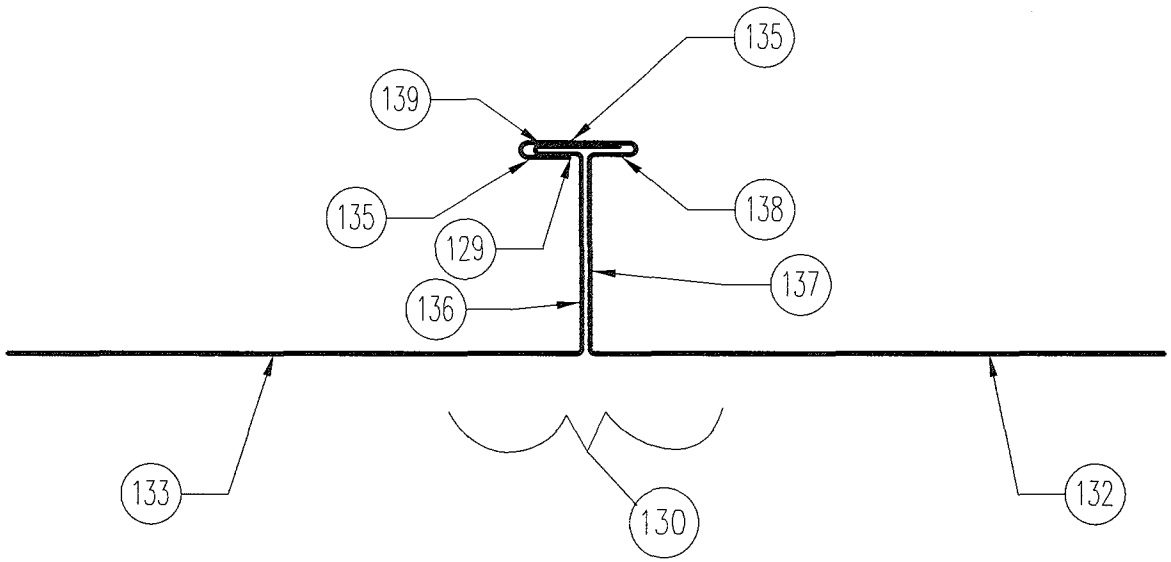
FIG. 10 is a cross-sectional view of the interlocked female and male portions of FIG. 8 after the deformation of the extended edge of the female portion has occurred.
Figure 11:
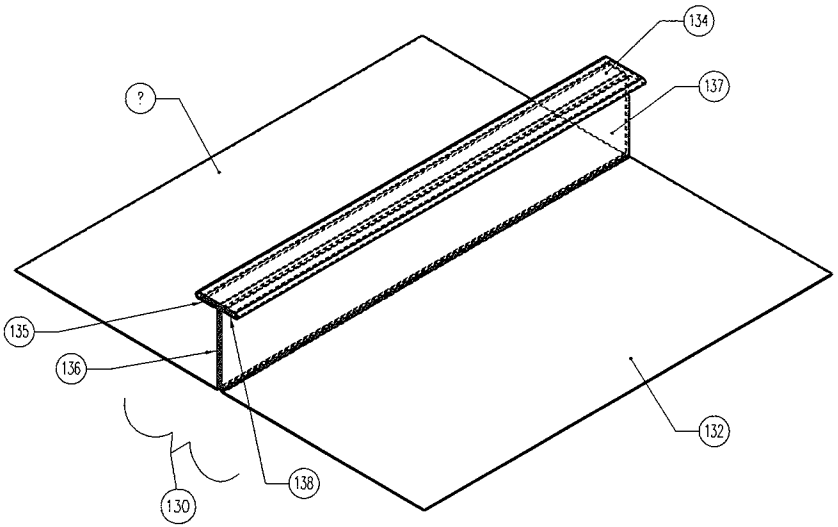
FIG. 11 is an isometric view of the same interlocked roof panels of FIG. 10.

FIGS. 10 and 11 thus show the same interlocked panels of FIGS. 8 and 9, wherein the extended "T" shape edge 135 has been deformed along the entire length of the panel 132 to, at least, initially attached the two panels 132, 133 together at the interlocked seam 130.

Figure 12:
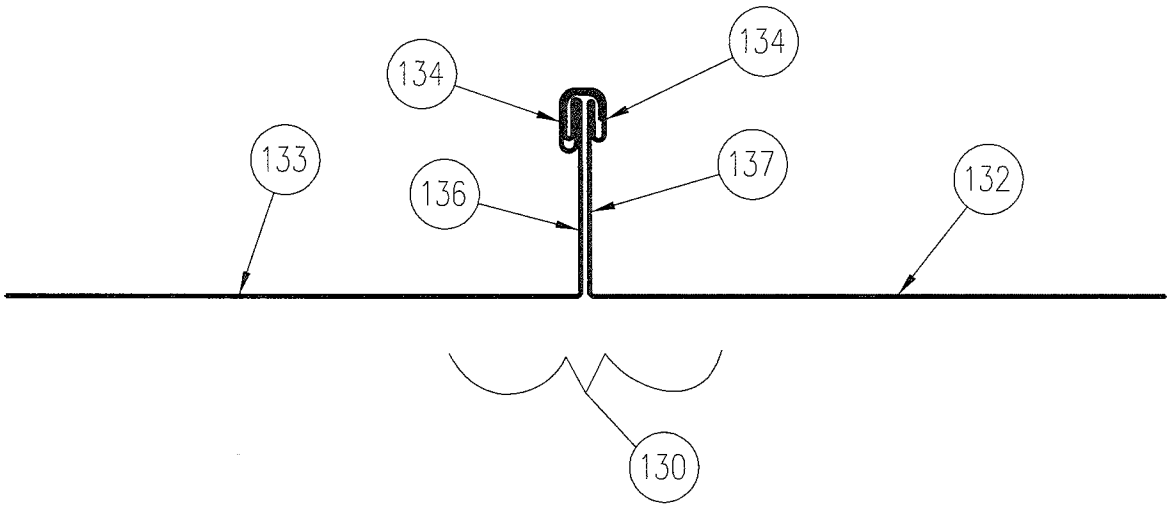
FIG. 12 is a cross-sectional view of the double-seamed interlocked female and male portions of FIG. 10.
Figure 13:
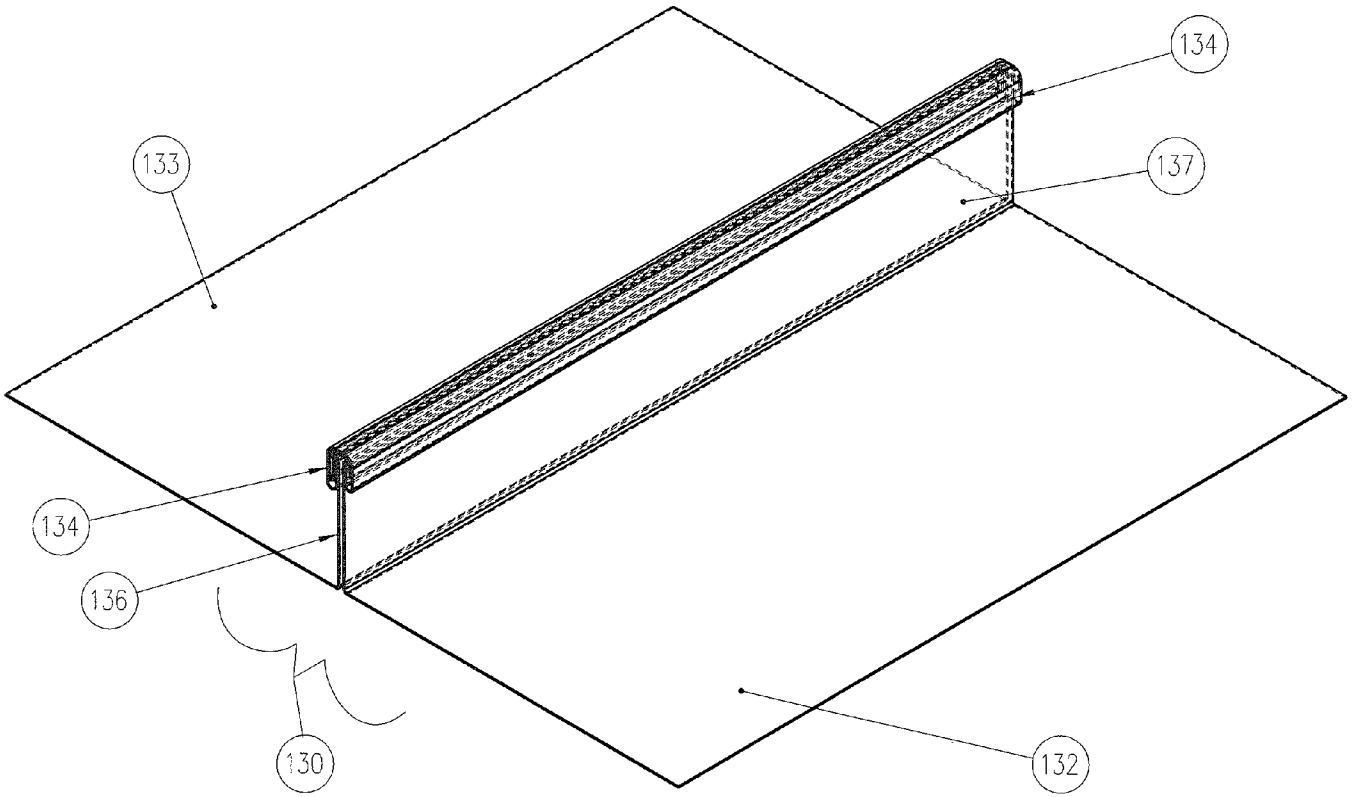
FIG. 13 is an isometric view of the same double-seamed roof panels of FIG. 12.

FIGS. 12 and 13 further depict the completed double-sided seam 130 subsequent to the initial interlocking shown in FIGS. 8 and 9, as well as in FIGS. 10 and 11. With the deformation of the top end 134 of the female end portion in a dual direction parallel, at least substantially, to that of the straight rises 136, 137, the completed seam 130 has been formed. Thus, the overall appearance of the seamed roof panels is of a substantially planar seam perpendicular to the center panel components 132, 133. A plurality of such double-sided seamed adjacent roof panels can thus be connected in line to form an overall roof assembly (as in FIG. 1).

Figure 14:
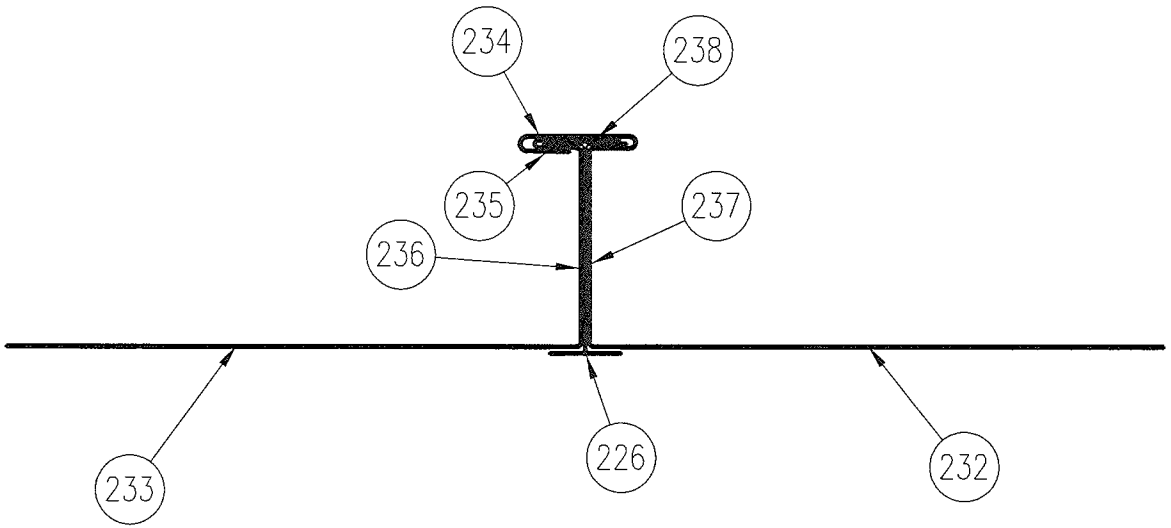
FIG. 14 is a cross-sectional view of interlocked female and male portions of another potentially preferred embodiment of two inventive roof panels after the deformation of the extended edge of the female portion has occurred and including a clip for the attachment thereof to an underlying building structure.
Figure 15:
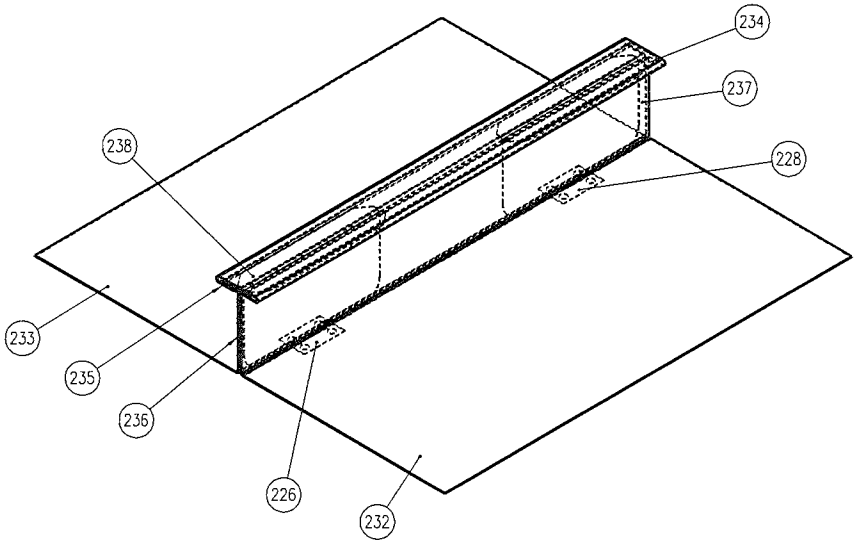
FIG. 15 is an isometric view of the same interlocked and female end deformed roof panels of FIG. 14.

FIGS. 14 and 15 mirror the depictions of FIGS. 8 and 9, but including T-clips 226, 228 for the attachment of panels 232, 233 to an underlying building structure (not illustrated). The straight rises 236, 237 of the two panels 232, 233 with a extended "T" shape female portion (120 of FIGS. 4 and 5) accommodating a "T" shape male portion (110 of FIGS. 2 and 3) and exhibiting a deformed extended "T" shape edge 235 are present as is the connecting seam 230 between the two panels 232, 233. The overall top end 234 remains flat, and the resultant edge 235 and top edge component 238 of the female portion remain in the "T" shape as well. Again, this configuration runs the length of the rises 236, 237 and of the panels 232, 233.

Figure 16:
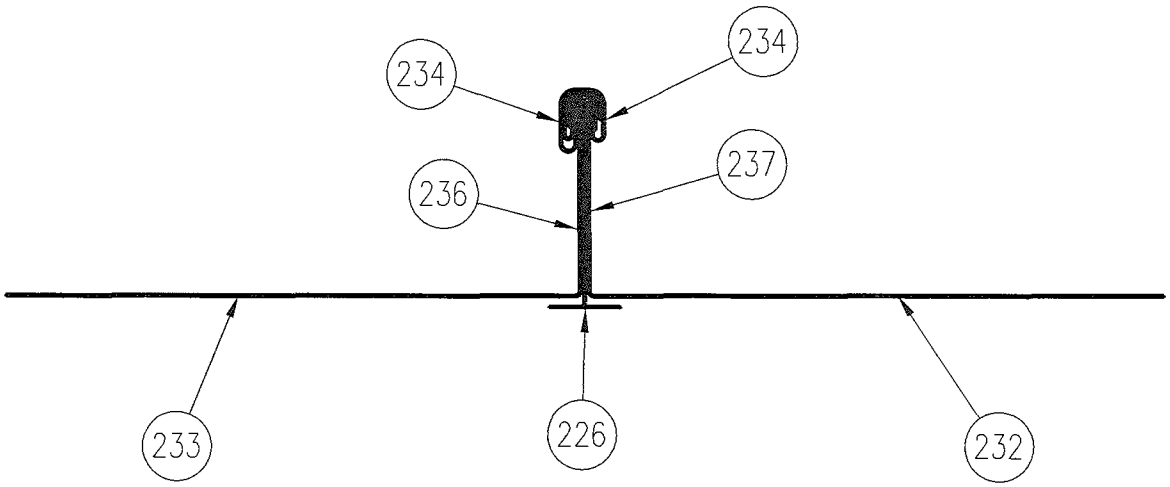
FIG. 16 is a cross-sectional view roof panels showing the double-seamed interlocked clip-including female and male portions of FIG. 14.
Figure 17:
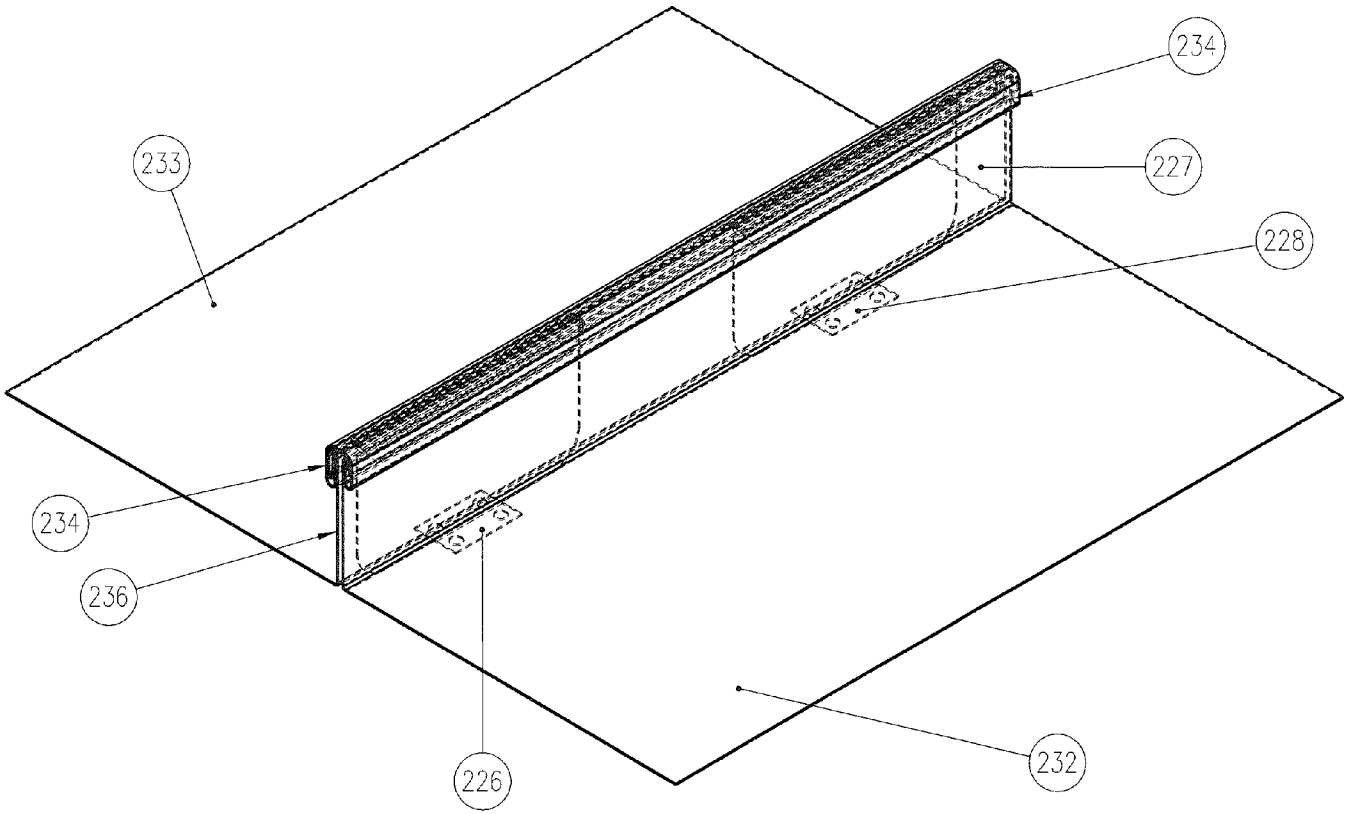
FIG. 17 is an isometric view of the same double-seamed roof panels of FIG. 16.

Mirroring FIGS. 12 and 13, then, FIGS. 16 and 17 depict the same T-clips 226, 228 used for attachment of the panels 232, 233 to a building structure (not illustrated) and with the fully formed double-sided seam 230 from the deformation of the edge 235 and the top edge component 238 (as well as the accommodated complementary portions of the male end 110 of FIGS. 2 and 3) folded downward substantially parallel to the rises 236, 237. The resultant double-sided seam 230 runs the length of the roof panel rises 236, 237 as before, too.

Figure 18:
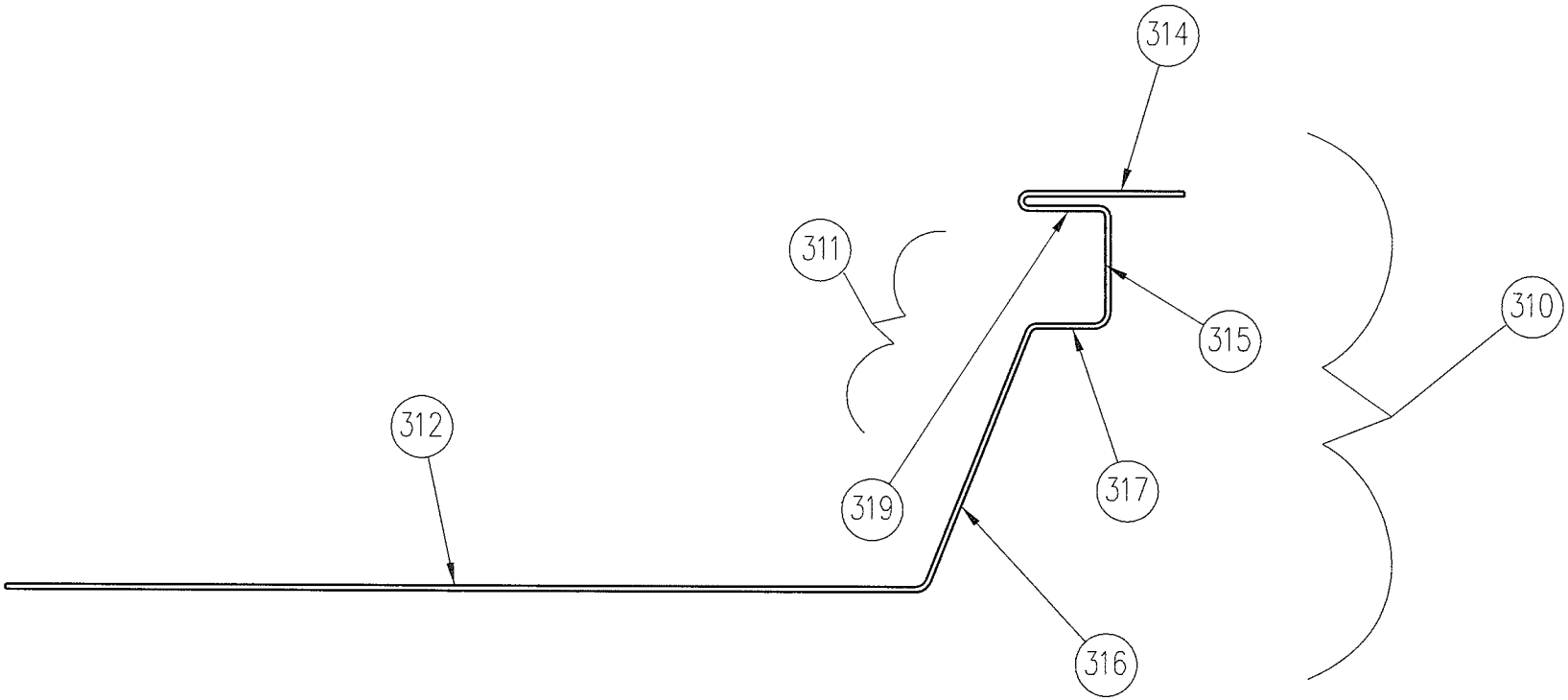
FIG. 18 is a cross-sectional view of the male end portion of an inventive trapezoidal roof panel.
Figure 19:
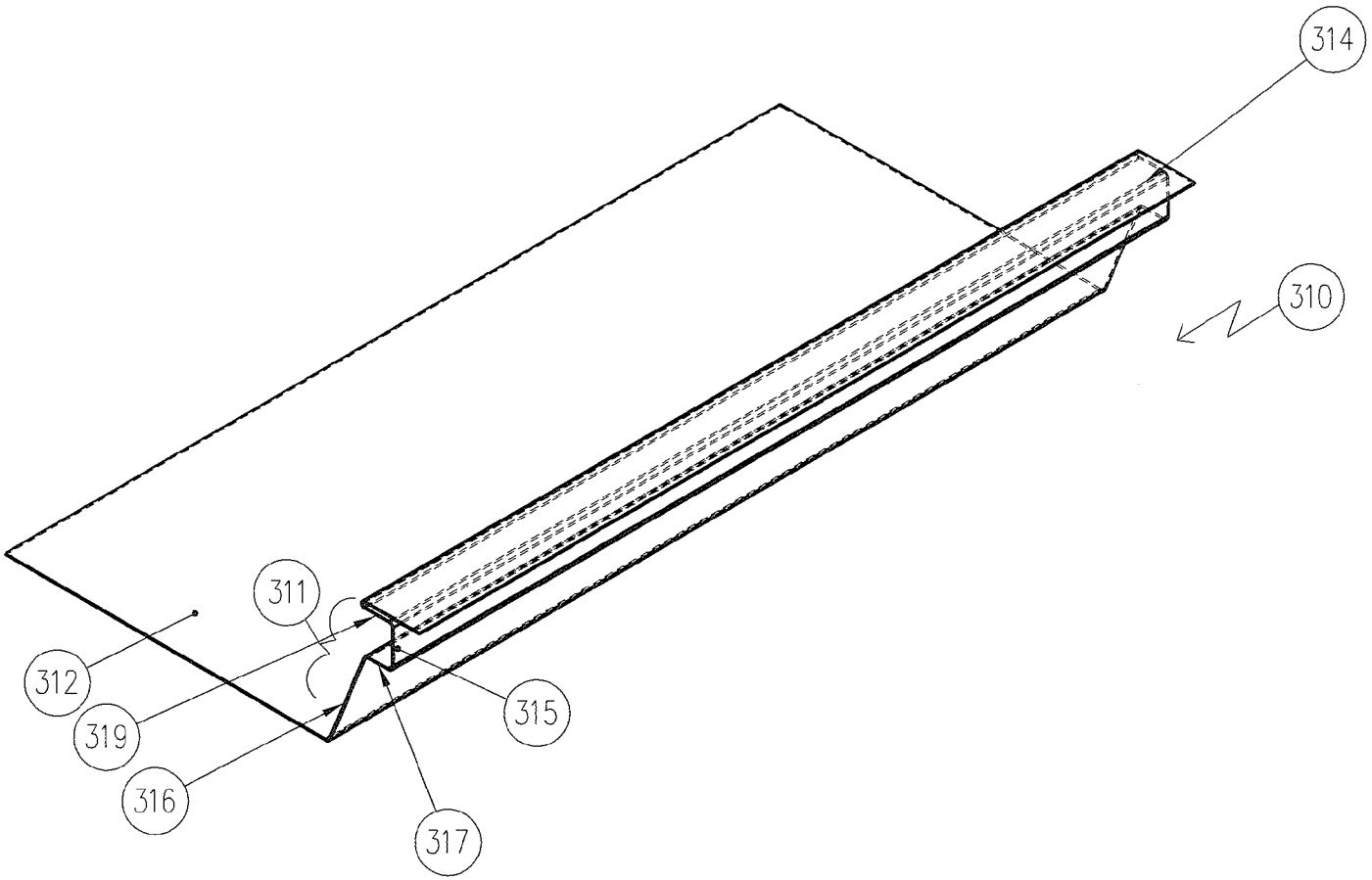
FIG. 19 is an isometric view of the same male end portion of FIG. 19.

FIGS. 18 and 19 depict the male end portion 310 of an inventive trapezoidal end panel (partially shown as the center panel component 312). The end portion 310 includes an elevated multi-angled rise 311 (i.e., includes at least one bend at substantially 90° from the plane of the center panel component 312 and at least one other bend of greater than 90°) that leads into a top end component 318. In this potentially preferred embodiment, the rise 311 includes a first bend in the material at an angle greater than 90° away from the plane of the center panel component 312 that forms a first rise portion 316. A second bend in the opposite direction from the first bend is present that is likewise greater than 90° from the first rise component to form a second rise component 317. In this embodiment the bend to form the first rise component 316 is roughly 120° and the bend to form the second rise component 317 is roughly the same in degree. As such, the second rise component 317 is roughly parallel to the plane of the center panel component 312. The top rise component 315 of the rise 311 is then formed through a bend in the material at roughly 90° from the second rise component 317. A further bend is then substantially 90° from the plane of the top rise component 315 back toward the direction of the center panel component 312 and forms another portion 319 that is substantially parallel to the plane of the center panel component 312. Another bend of substantially 180° in the material creates a top edge 314 that extends beyond the furthest point of the rise top rise component 315 in relation to the center panel component 312. This male end portion 310 thus forms a "T" shaped configuration, which meets the definition of such a term as above. As noted in FIG. 19, the "T" shaped configuration extends along the entire length of the rise 311.

Figure 20:
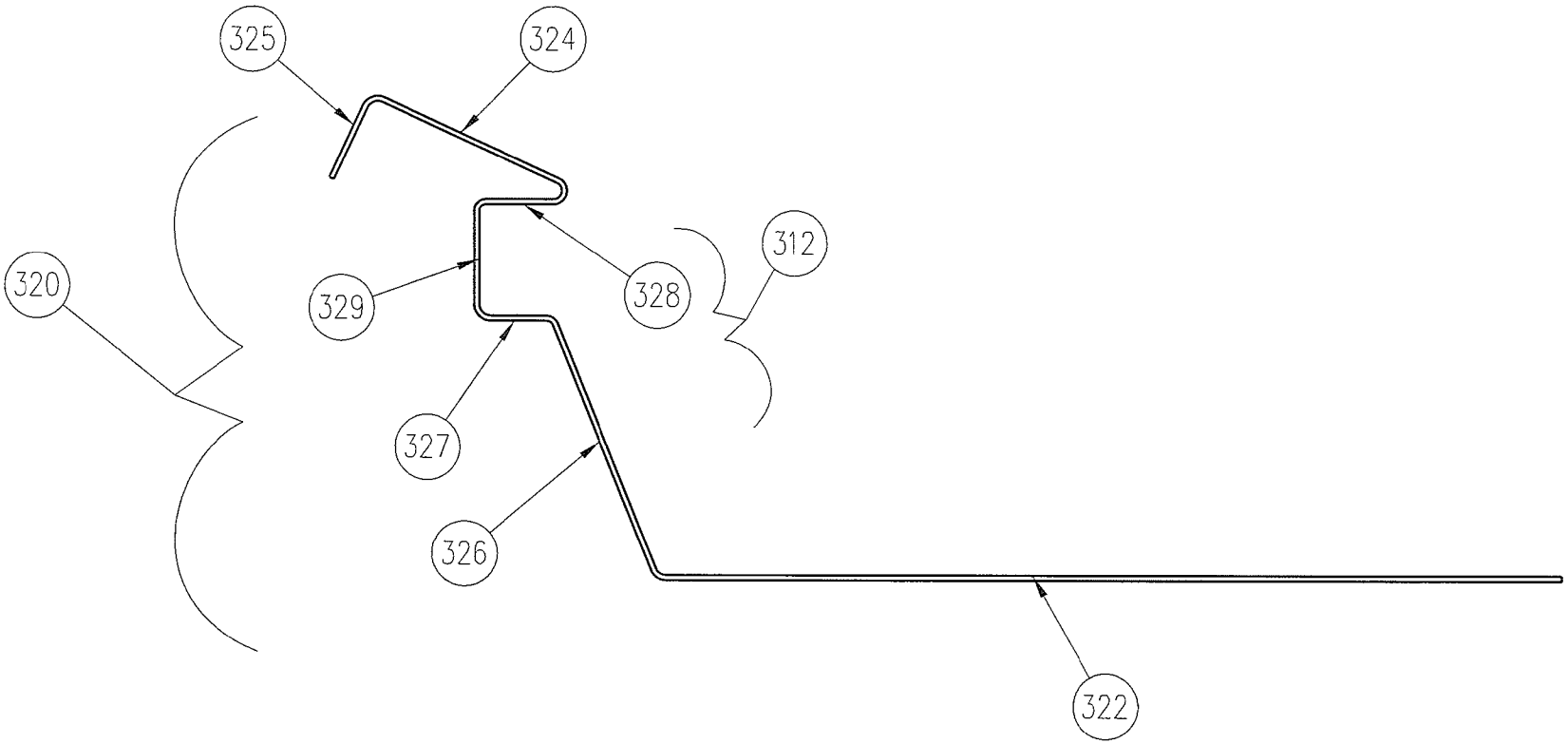
FIG. 20 is a cross-sectional view of the female portion of an inventive trapezoidal roof panel.
Figure 21:
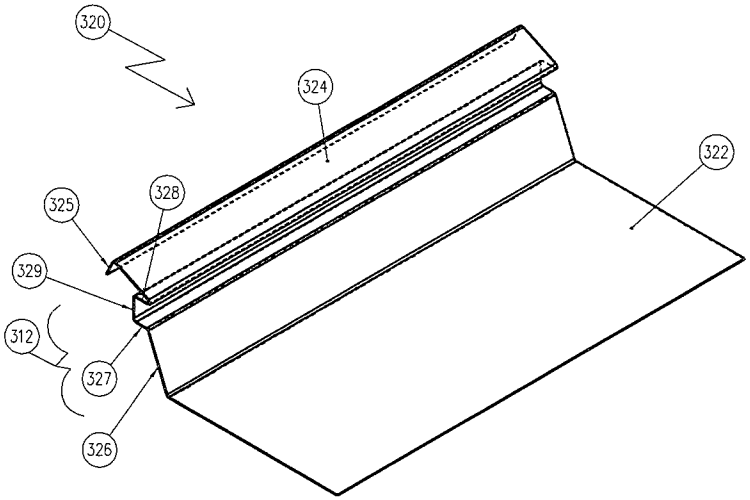
FIG. 21 is an isometric view of the same female end portion of FIG. 20.

FIGS. 20 and 21 depict the female end portion 320 of an inventive trapezoidal end panel (partially shown as the center panel component 322). The end portion 320 includes an elevated multi-angled rise 321 (i.e., includes at least one bend at substantially 90° from the plane of the center panel component 322 and at least one other bend of greater than 90°) that leads into a top end component 328. In this potentially preferred embodiment, the rise 321 includes a first bend in the material at an angle greater than 90° away from the plane of the center panel component 322 that forms a first rise portion 326. A second bend in the opposite direction from the first bend is present that is likewise greater than 90° from the first rise component to form a second rise component 327. In this embodiment the bend to form the first rise component 326 is roughly 120° and the bend to form the second rise component 327 is roughly the same in degree. As such, the second rise component 327 is roughly parallel to the plane of the center panel component 322. The top rise component 329 of the rise 321 is then formed through a bend in the material at roughly 90° from the second rise component 327. That leads into a top end component 328 that bends substantially 90° from the plane of the top rise component 329 back toward the direction of the center panel component 322 and is substantially parallel to the plane of the center panel component 322. Another bend is present in the material creating an acute angle (i.e., greater than 0 but less than 90°) from the plane of the top end component 328. In this embodiment, the acute angle is roughly 30° and extended top portion 324 is created within the end portion 320 as a result. The edge 325 of the end portion 320 is then created by a further bend (of any angle; in this preferred embodiment the angle is roughly 90° from the extended top portion 324) that further extends a distance below the extended top portion 324. Such a configuration thus meets the definition of extended "T" shape as presented above. As noted in FIG. 21, the extended "T" shaped configuration extends along the entire length of the rise 321.

Figure 22:
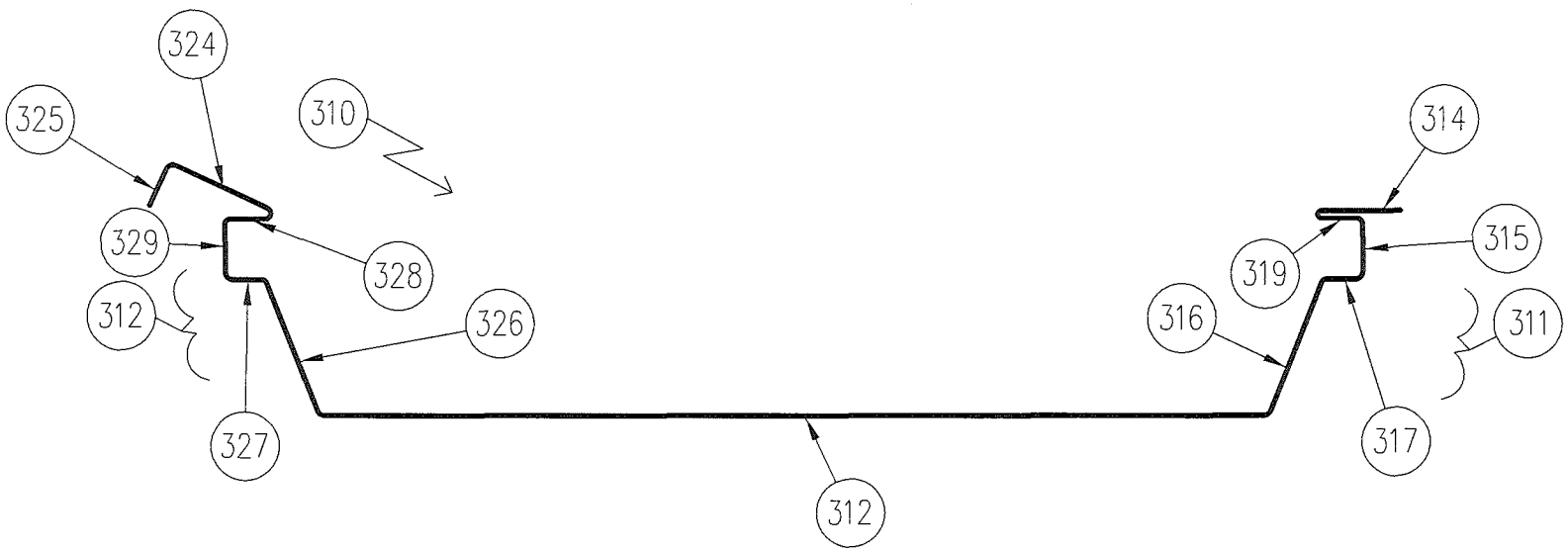
FIG. 22 is a cross-sectional view of one potentially preferred embodiment of an inventive trapezoidal roof panel.
Figure 23:
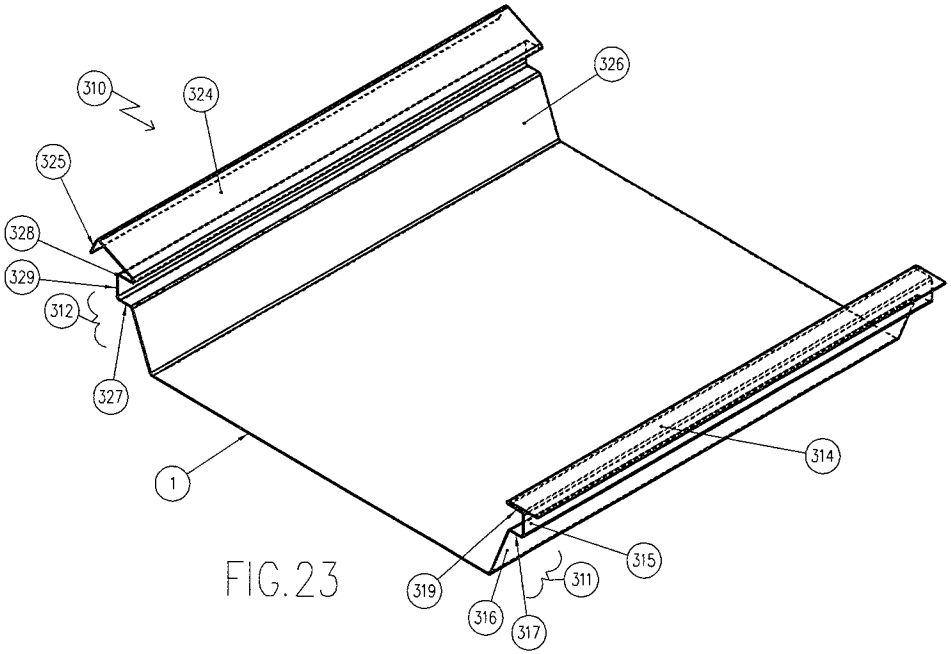
FIG. 23 is an isometric view of the same roof panel of FIG. 22.

FIGS. 22 and 23 thus depict an entire inventive trapezoidal panel including the same configurations as in FIGS. 18, 19, 20, and 21, above. The water run-off capability (as well as the aesthetic appearance) of a roof assembly made from multiple connected panels of this type is highly desirable. A plurality of such roof panels 310 can thus be attached in the accommodating manner as presented in FIGS. 8, 9, 10, 11, 12, and 13, at least, to form an overall roof assembly (as in FIG. 1, for example).

The double-sided seams provided by the inventive roof panels, and thus the overall roof assemblies made therefrom, provide highly improved wind updraft resistance levels (such that the compromise level is dependent upon the strength of attachment clips and/or bolts, and the like) to an underlying building structure as opposed to the threshold integrity of the roof panels in seamed configuration.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A single-construction metal roof panel having a first end having a first edge and a second end having a second edge, wherein said first edge and said second edge of said panel are opposite one another on either side of a center panel component; wherein said first and second ends are elevated out of the plane of said center panel component; wherein said first end is configured to exhibit a "T" shape with its edge extending away from the plane of said center panel; wherein said "T" shape is defined wherein said first edge of said first end of said panel is substantially parallel to at least a portion of said center panel component, such that 1) said first end includes i) a first end rise that is at least one bend from said center panel component at an angle greater than 0 and at most 90° from the plane of said center panel component, ii) a first end flange that includes a 90° bend away from said rise and toward a plane parallel to said center panel component, and iii) a single 180° bend in the direction opposite of said 90° bend also in a direction substantially parallel to the plane of said center panel component which leads to said first edge of said first end, and wherein said first edge of said first end of said roof panel extends beyond the furthest point of said first end rise away from said center panel component; wherein said second end is configured to exhibit an extended "T" shape with its edge extending away from the plane of said center panel; wherein said extended "T" shape is defined wherein 2) said second end includes i) a second end rise that is at least one bend at an angle greater than 0 and at most 90° from the plane of said center panel component, ii) a second end flange that includes a 90° bend away from said rise and toward a plane parallel to said center panel component, iii) an acute angle bend that is less than 180° in the direction opposite of said second end flange, and iv) a further bend of any angle that leads to said second edge of said second end, and wherein said second edge of said second end of said roof panel extends beyond the furthest point of said second end rise away from said center panel component; wherein said "T" shape of said first end is complementary in shape to said extended "T" shape such that said extended "T" shape end will accommodate the entire length of the "T" shaped end if nested together.

2. The roof panel of claim 1 wherein said second end flange of said panel is complementary in shape to accept a first end flange from a substantially identical single-construction roof panel.

3. A roof assembly including at least one of the panels described in claim 2.

4. A method of forming a roof assembly of a plurality of such roof panels as described above in claim 1 through the complementary introduction of a first end flange of one roof panel into the second end flange of an adjacent roof panel to form a seam connection along the rises of both roof panel flanges and thereafter seaming both of said flanges together through the first deformation of the second edge of said second flange around the said first flange to form a "T"shaped connection seam with said first flange covered by said second flange, wherein said "T" shaped connection includes a configuration wherein one side of said "T" shaped connection includes the first edge of said first end flange of one roof panel and the other side of said "T" shaped connection includes the second edge of said second end flange of the other roof panel.

5. A roof assembly erected through the method of claim 4.

6. A method of forming a roof assembly of a plurality of such roof panels as described above in claim 1 through the complementary introduction of a first end flange of one roof panel into the second end flange of an adjacent roof panel to form a "T" shaped seam connection and thereafter seaming both of said flanges together through deformation of said "T" shaped connection seam such that both of the top ends of said "T" shaped connection seam are manipulated to a direction substantially perpendicular to said center panel component, and wherein said deformation manipulates the "T" shape of both roof panel flanges within said connection seam downwards until the edges are folded over and in contact with at least a portion of both rises of said adjacent panels.

7. A roof assembly erected through the method of claim 6.

8. A roof assembly including at least one of the panels described in claim 1.

9. A method of forming a roof assembly of a plurality roof panels wherein each of said plurality of roof panels is a single-construction metal roof panel having a first end having a first edge and a second end having a second edge, wherein said first edge and said second edge of said panel are opposite one another on either side of a center panel component; wherein said first and second ends are elevated out of the plane of said center panel component; wherein said first end is configured to exhibit a "T" shape with its edge extending away from the plane of said center panel; wherein said "T" shape is defined wherein said first edge of said first end of said panel is substantially parallel to at least a portion of said center panel component, such that 1) said first end includes i) a first end rise that is at least one bend from said center panel component at an angle greater than 0 and at most 90° from the plane of said center panel component, ii) a first end flange that includes a 90° bend away from said rise and toward a plane parallel to said center panel component, and iii) a further 180° bend in the direction opposite of said 90° bend also in a direction substantially parallel to the plane of said center panel component which leads to said first edge of said first end, and wherein said first edge of said first end of said roof panel extends beyond the furthest point of said first end rise away from said center panel component; wherein said second end is configured to exhibit an extended "T" shape with its edge extending away from the plane of said center panel; wherein said extended "T" shape is defined wherein 2) said second end includes i) a second end rise that is at least one bend at an angle greater than 0 and at most 90° from the plane of said center panel component, ii) a second end flange that includes a 90° bend away from said rise and toward a plane parallel to said center panel component, iii) an acute angle bend that is less than 180° in the direction opposite of said second end flange, and iv) a further bend of any angle that leads to said second edge of said second end, and wherein said second edge of said second end of said roof panel extends beyond the furthest point of said second end rise away from said center panel component; wherein said "T" shape of said first end is complementary in shape to said extended "T" shape such that said extended "T" shape end will accommodate the entire length of the "T" shaped end if nested together; said method comprising the complementary introduction of a first end flange of one roof panel into the second end flange of an adjacent roof panel to form a "T" shaped seam connection and thereafter seaming both of said flanges together through deformation of said "T" shaped connection seam such that both of the top ends of said "T" shaped connection seam are manipulated to a direction substantially perpendicular to said center panel component, and wherein said deformation manipulates the "T" shape of both roof panel flanges within said connection seam downwards until the edges are folded over and in contact with at least a portion of both rises of said adjacent panels.

10. A roof assembly erected through the method of claim 9.

* * * * *